US006430386B2

(12) United States Patent
Okubo et al.

(10) Patent No.: US 6,430,386 B2
(45) Date of Patent: Aug. 6, 2002

(54) IMAGE HEATING APPARATUS PROVIDED WITH A BODY THAT IS MOVABLE WITH A RECORDING MATERIAL

(75) Inventors: Takateru Okubo, Susono; Masao Umezawa; Masanori Yamagata, both of Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/760,700

(22) Filed: Jan. 17, 2001

(30) Foreign Application Priority Data

Jan. 20, 2000 (JP) ..... 2000-011816

(51) Int. Cl.[7] ..... G03G 15/20
(52) U.S. Cl. ..... 399/328; 219/216
(58) Field of Search ..... 399/328, 320, 399/336, 334; 219/216

(56) References Cited

U.S. PATENT DOCUMENTS 5,348,284 A 9/1994 Ishihama et al. ..... 271/160
5,970,299 A * 10/1999 Sano et al. ..... 399/330

FOREIGN PATENT DOCUMENTS

JP 8-171297 A * 7/1996
JP 9-237001 9/1997
JP 10-198202 A * 7/1998

* cited by examiner

*Primary Examiner*—Quana M. Grainger
(74) *Attorney, Agent, or Firm*—Fitzpatrick, Cella, Harper & Scinto

(57) ABSTRACT

The present invention provides an image heating apparatus that has a movable member, a guide member for guiding a movement of the movable member, and a back up member for forming a nip portion with the guide member via the movable member, wherein a recording material bearing an image at said nip portion is pinched and conveyed, the image on the recording material is heated by a heat from the movable member side, and wherein the guide member has a recess portion in a guide portion different from the nip portion.

12 Claims, 5 Drawing Sheets

IMAGE HEATING APPARATUS PROVIDED WITH A BODY THAT IS MOVABLE WITH A RECORDING MATERIAL

BACKGROUND OF THE INVENTION

1. Field of the Invention

The present invention relates to an image heating apparatus to be applied to an image forming apparatus such as a copying machine and a printer, and more particularly to an image heating apparatus provided with a movable (moving) body which slides on a guide member and moves together with a recording material.

2. Related Background Art

In a heating apparatus including: a film, which is a movable body; a guide member for guiding the film; a pressurizing member pressure contacting with the guide member via the film to form a nip; and heating means for raising the film in temperature to heat a member to be heated, which is conveyed within the nip with movement of the film, when the process speed is speeded up, that a frictional resistance between the film and the guide member becomes high, thereby there may result a drawback such as a deviation of the film and a generation of a wrinkle.

In Japanese Patent Application Laid-Open No.9-237001, it has been disclosed that on a guide surface of the guide member for guiding the film, there are provided a plurality of rib-shaped guide portions which are spaced apart in a moving direction of the film or in a direction for intersecting the moving direction of the film, whereby there is provided the effect that frictional resistance between the film and the guide member is reduced or the deviation of the film and occurrence of a wrinkle are restrained.

However, there has been a problem that when the guide member is provided with such a convex portion as the rib, the film is prone to be damaged.

Also, in a heating apparatus of a film heating system, lubricant (lubricating fats and oils or the like) has been conventionally interposed between the film and the guide member to thereby reduce the frictional resistance. In the case of an apparatus having the rib-shaped guide portions, however, it is difficult to uniformly disperse lubricant between the film and the guide member, and lubricant might leak out from an end portion of the film in the widthwise direction due to the use over a long term, thereby the effect of the lubricant being interposed is not exhibited sufficiently.

SUMMARY OF THE INVENTION

It is an object of the present invention to provide an image heating apparatus for improving slidability of the movable member on the guide member without causing any damage to the movable member.

It is another object of the present invention to provide an image heating apparatus including: a movable member; a guide member for guiding a movement of the movable member; and a back up member for forming a nip portion with the guide member via the movable member, in which a recording material bearing an image at the nip portion is pinched and conveyed, and the image on the recording material is heated by a heat from the movable member side, and the guide member has a recess portion in a guide portion different from the nip portion.

Still another object of the present invention will be apparent from the following description.

DETAILED DESCRIPTION OF THE PREFERRED EMBODIMENTS

Hereinafter, with reference to the drawings, the description will be made of embodiments of the present invention.

Figure 3:
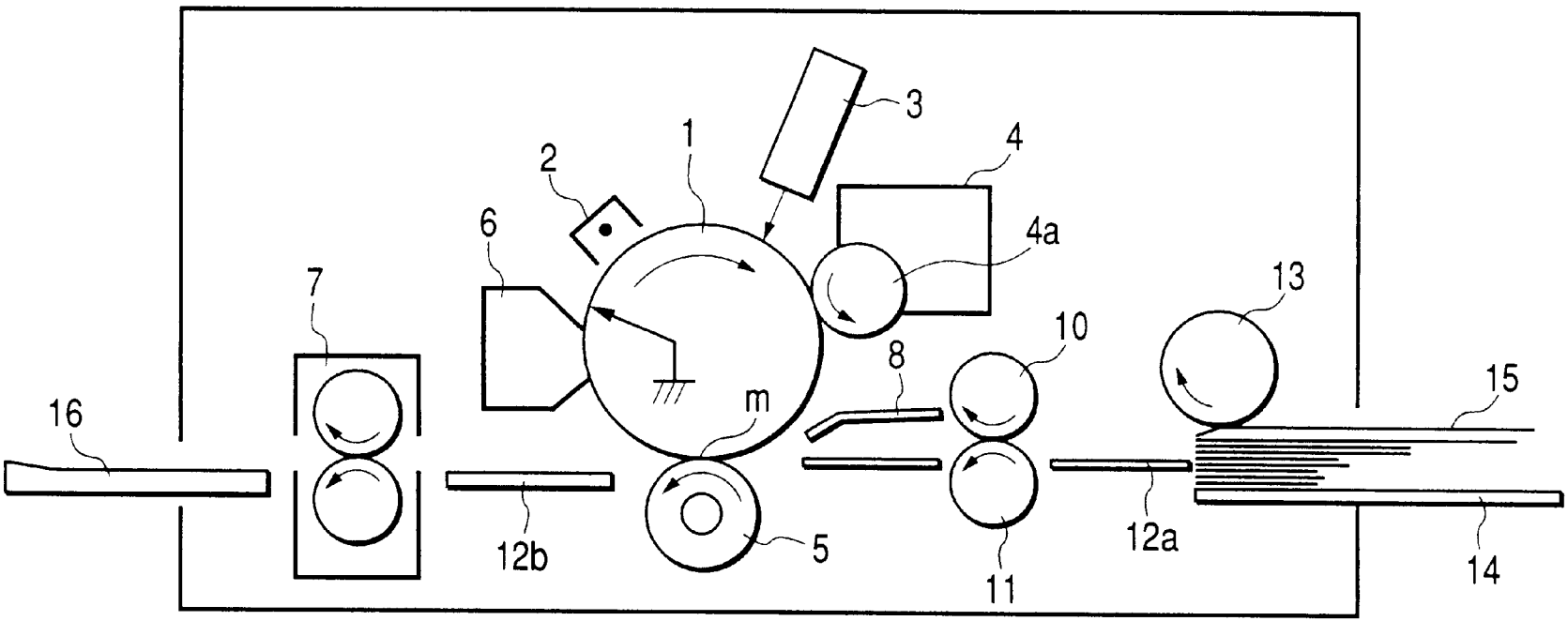
FIG. 3 is a view showing an image forming apparatus, to which an image heating apparatus according to the embodiment of the present invention has been applied.

First, with reference to FIG. 3, the description will be made of an image forming apparatus, to which an image heating apparatus according to an embodiment of the present invention is applied.

Reference numeral 1 denotes a rotary drum type electrophotographic photosensitive body (hereinafter, referred to as photosensitive drum) as an image bearing member. The photosensitive drum 1 is rotatively driven at a predetermined peripheral speed (process speed) in a clockwise direction indicated by an arrow, and is uniformly charged at a predetermined negative dark potential VD in the rotational process by a primary charger 2.

Reference numeral 3 denotes a laser beam scanner, and when object image information is inputted from a host apparatus such as an image reader, a word processor or a computer, which are not shown, the laser beam scanner 3 outputs a laser beam modulated in response to a time series electric digital image signal of the image information, and the surface of the photosensitive drum 1 which is uniformly negatively charged by the primary charger 2 as described above, is scanned and exposed, whereby an absolute value of the potential at the exposure portion becomes small into a light potential VL, and an electrostatic latent image corresponding to the object image information is formed on the surface of the photosensitive drum 1.

Subsequently, the latent image is reversal-developed (toner adheres to a laser exposed portion VL) by pulverulent toner negatively charged by a developer unit 4 to be visualized. The developer unit 4 has a development sleeve 4*a* to be rotationally driven. The development sleeve 4*a,* whose outer peripheral surface is coated with a thin layer of toner negatively charged, is opposed to the photosensitive drum 1 surface, and development bias voltage VDC, the absolute value of which is lower than dark potential VD of the photosensitive drum 1 and is higher than light potential VL is applied to the sleeve 4*a,* whereby toner on the sleeve 4*a* transfers to only a portion of the light potential VL of the photosensitive drum 1 so that the latent image is visualized (reversal-development).

On the other hand, recording materials 15 stacked and set on a sheet feeding tray 14 are paid out and fed one sheet at a time by driving of a sheet feeding roller 13, and each sheet is fed into a nip portion (transfer portion) m between the photosensitive drum 1 and a transfer roller 5 at adequate timing synchronized with the rotation of the photosensitive drum 1 via a conveying guide 12*a,* paired registration rollers 10 and 11 and transfer guides 8 and 9 so that a toner image on the photosensitive drum 1 surface side is successively transferred onto the surface of the recording material 15. In this respect, the transfer roller 5 is used as a transfer member, to which transfer bias is applied by causing the transfer roller 5 to abut upon the photosensitive drum 1.

The recording material 15 passed through the transfer portion is separated from the photosensitive drum 1 surface, is introduced into a fixer 7 by the conveying guide 12*b* to fix the transfer toner image there, and is outputted into a sheet discharging tray 16 as image formation object (print). After the recording material is separated, any residue on the photosensitive drum 1 surface such as transfer residual toner is removed by a cleaning unit 6, and the photosensitive drum 1 surface is made clean, and is repeatedly used to form an image.

Figure 1A:
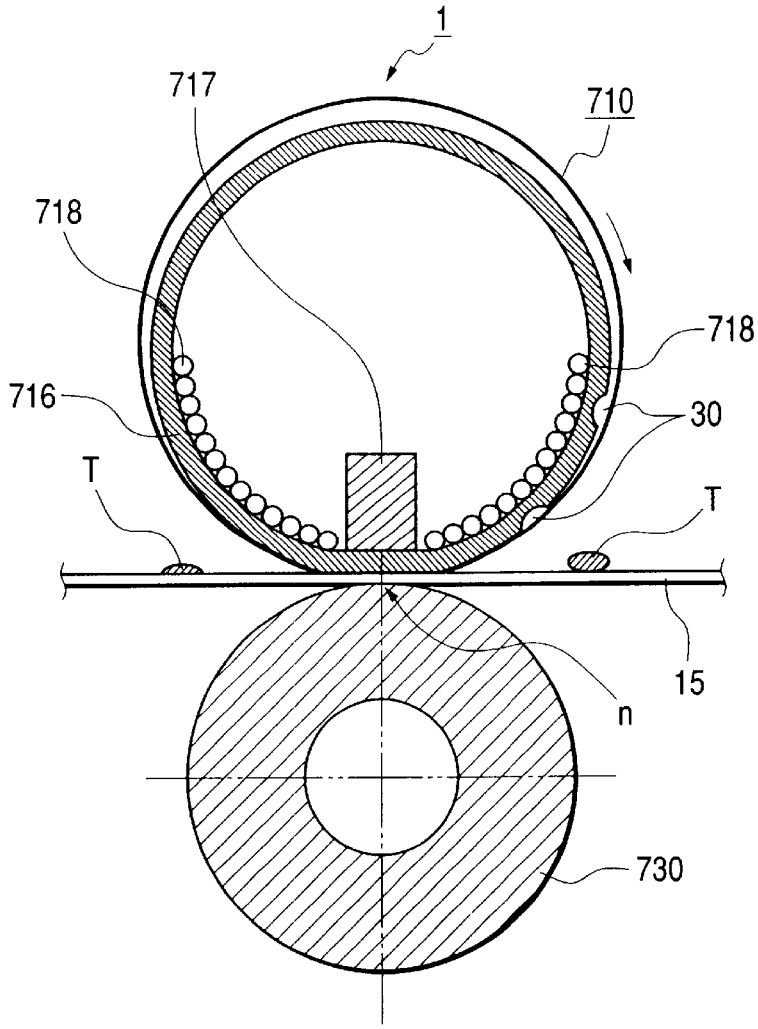
FIGS. 1A and 1B are views showing an image heating apparatus according to an embodiment of the present invention.
Figure 1B:
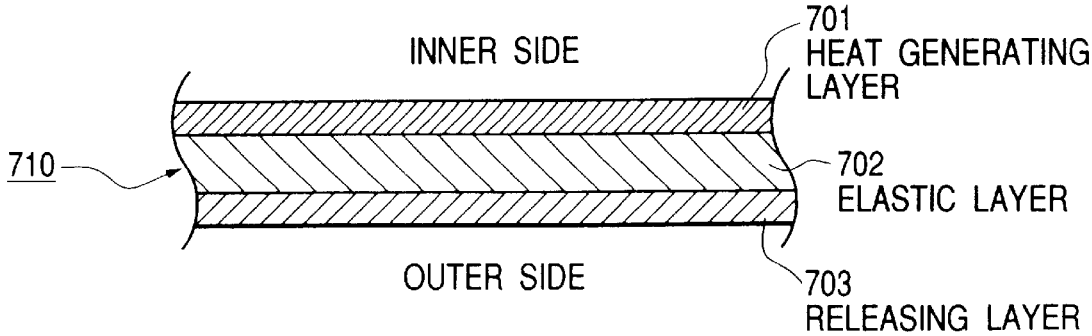

Next, the detailed description will be made of a fixing device, which is an image heating apparatus according to the present invention. First, the configuration of the entire fixing device will be described. FIG. 1A is a cross-sectional view showing the fixing device 7 according to the present invention, and FIG. 1B is a cross-sectional view showing fixed film for the fixing device 7. Reference numeral 710 denotes endless-shaped film, which is a movable member, and as shown in FIG. 1B, there is provided an elastic layer 702 on the outer side of a heat generating layer (conductive layer) 701, and on the outer side of this elastic layer 702, there is provided a releasing layer 703. Reference numeral 716 denotes a film guide, which is a guide member, and this film guide 716 guides movement of the film 710 on the inner side thereof. The film 710 is loose wound around the film guide 716 with an allowance.

The film 710 rotates in a direction indicated by an arrow, and the film guide 716 gives pressure to the nip portion n, and conveyance stability to the film.

Further, the film guide 716 supports a core 717 and a coil 718 as magnetic field (magnetic flux) generating means. For the core 717, material with high magnetic permeability such as ferrite and permalloy to be used for a transformer core is preferably used, and ferrite which has less loss even at 100 kHz or more is more preferably used.

An exciting circuit which is not shown is connected to the coil 718, and this circuit is adapted to be able to generate high frequency of 20 kHz to 500 kHz through the use of switching power supply.

The film guide 716 equipped with the magnetic field generating means or the like and a pressurizing roller 730, which is a back up member, are brought into press contact to form the nip portion n while the film 710 is sandwiched therebetween. A pressurizing roller 730 is a driving roller for driving the film 710. Between the film 710 and the film guide 716, there is provided lubricating grease, which is lubricant.

A principle of heating within the nip portion n is that alternating magnetic flux generated by applying high-frequency current from the exciting circuit to the coil 718 is guided by a high magnetic permeability core 717 to act on the heat generating layer 701 of the film 710 in the vicinity of the nip portion n for generating eddy current, and this eddy current and specified resistance of the heat generating layer 701 generate the heat.

The heat thus generated is imparted to the recording material 15 to be conveyed to the nip portion n and toner T on the recording material via the elastic layer 702 and the releasing layer 703 to melt the image of the toner T. Thus, the toner image melted within the nip portion n is fixed on the recording material, and after the passage in the nip portion n, it is naturally cooled into a permanent fixed image.

Figure 2A:
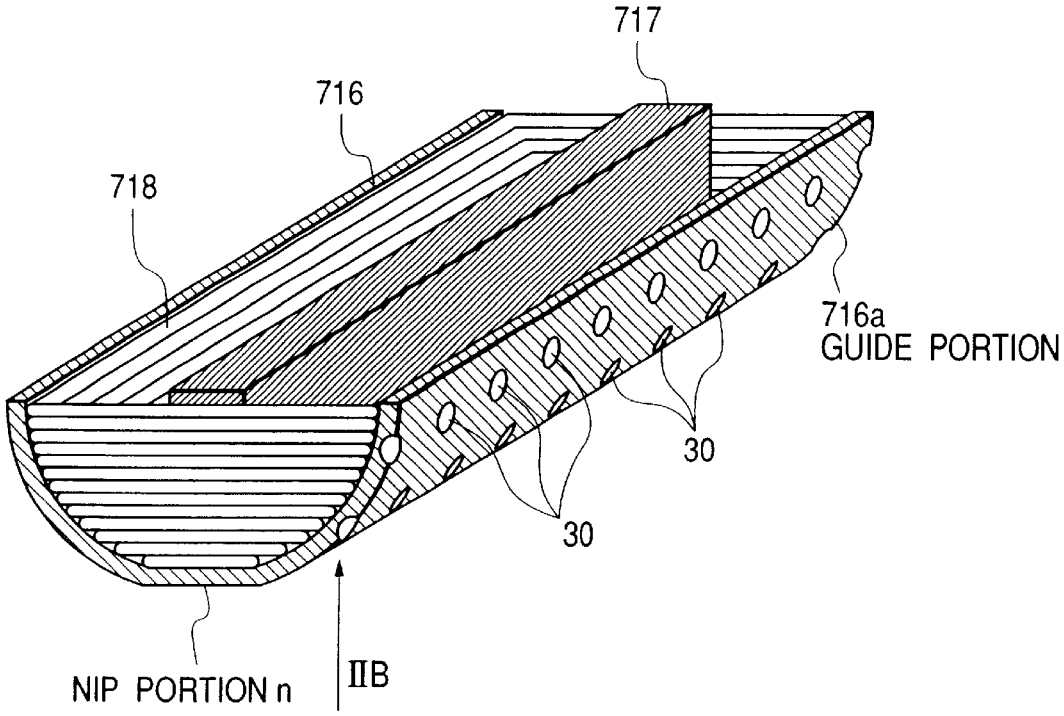
FIGS. 2A and 2B are views showing a guide member according to the embodiment.
Figure 2B:
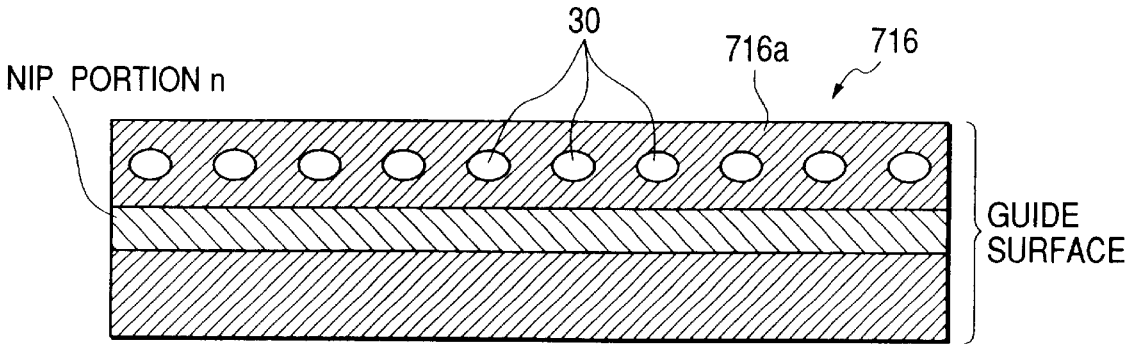

FIG. 2A is a perspective view showing the lower part of the film guide 716, and FIG. 2B is a bottom view as viewed from the nip portion n (direction indicated by an arrow IIB) of FIG. 2A.

In the present embodiment, as shown in FIGS. 2A and 2B, on a guide portion 716*a* different from the nip portion n on the surface (guide surface) of the film guide 716, there are provided dimples, each of which includes a spherical-ring-shaped recess portion, which is a hole for holding lubricating grease.

When the dimple 30 uses lubricating fats and oils or the like (lubricating grease in the present embodiment) in order to reduce the sliding resistance with the film surface, it becomes possible to hold the grease within the dimple on the surface of the guide portion over a long term without lubricating grease leaking out from the end portion of the film, and in the present embodiment, dimples with a spherical diameter of 5 mm are formed at intervals of 10 mm over up to 45° at the upstream in the film moving direction from the nip portion n of the guide surface.

As described above, there are provided dimples on the film guide surface, whereby a contact area between the film 710 and the film guide 716 is reduced to reduce a frictional force without causing any damage to the film and it is made possible to hold the lubricating grease over a long term, and lubricant can be certainly imparted to the film before the film enters the nip portion having high sliding resistance.

Also, the dimples 30 are discontinuously disposed in the moving direction of the film 710, and the dimple portion has a smaller area in the uniform surface on the guide surface, which eliminates any nonuniform temperature distribution. In other words, this prevents heterogeneity in temperature distribution in the widthwise direction of the film.

As described above, according to the present embodiment, it is possible to reduce the contact area between the film and the film guide, to reduce the frictional force, to hold the lubricating grease over a long term, and it becomes possible to give the film (movable body) greater durability and to speed up the processing.

Also, since the sliding resistance between the film and the guide member at the upstream side of the nip portion is greater than that at the downstream side in the moving direction of the film, it is effective to provide a recess portion in advance at least upstream side of the nip portion as in the present embodiment.

Figure 4A:
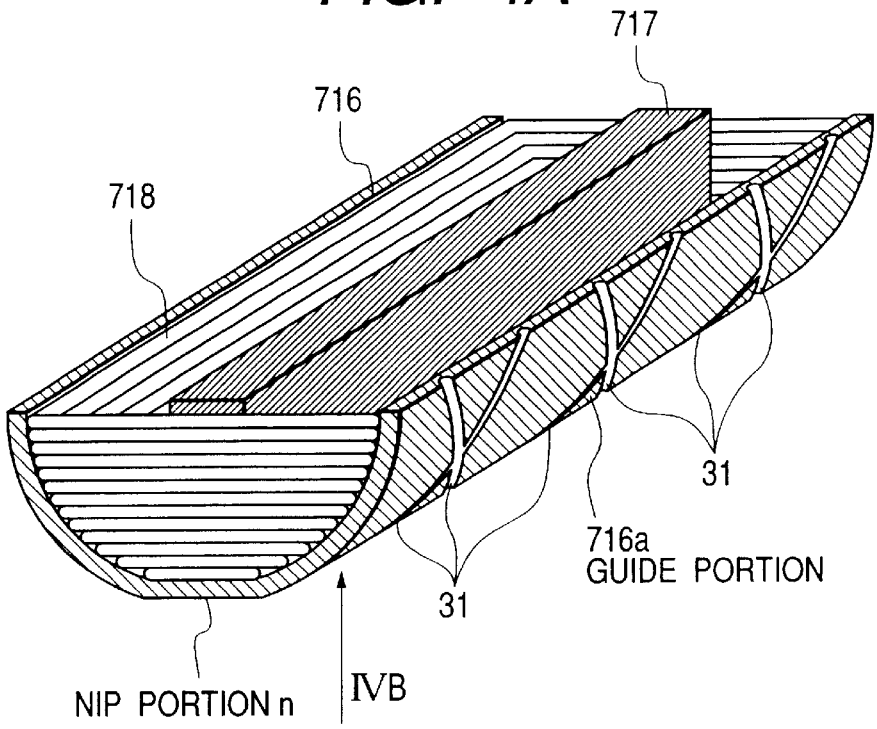
FIGS. 4A and 4B are views showing a guide member according to another embodiment.
Figure 4B:
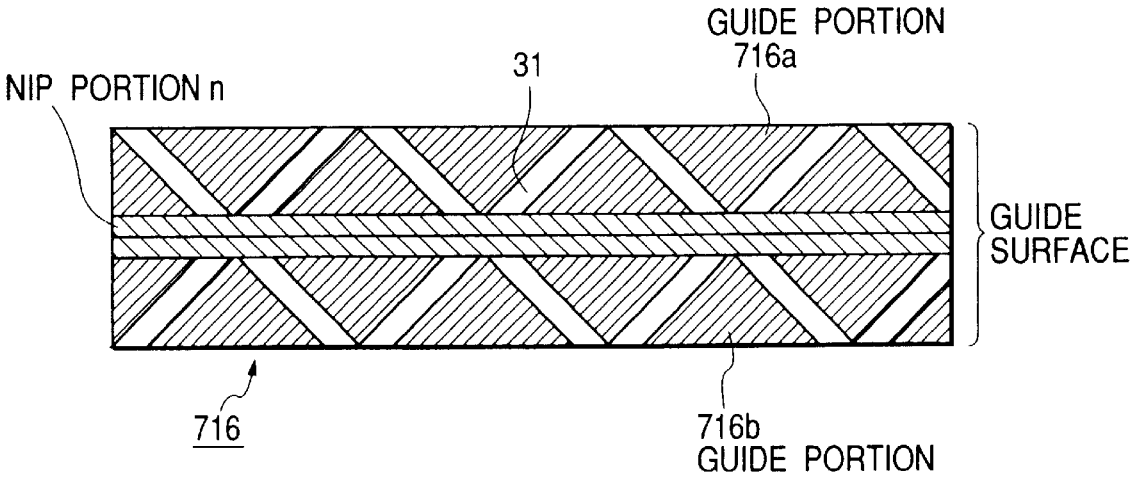

FIGS. 4A and 4B show another embodiment according to the present invention: FIG. 4A is a perspective view showing the lower part of the film guide 716; and FIG. 4B is a bottom view as viewed from the nip portion n (direction indicated by an arrow IVB) of FIG. 4A.

In the present embodiment, as shown in FIGS. 4A and 4B, on guide portions 716A and 716B different from the nip portion n on the surface of the film guide 716, there are disposed grooves 31 in a lattice shape as a plurality of recess portions. The grooves 31 are capable of holding lubricating grease over the entire circumference of the surface of the film guide 716, and of holding lubricating grease over a long term as in the above described embodiment. In the present embodiment, the grooves are formed in a lattice shape at intervals of 20 mm which obliquely cross the moving direction of the film. In other words, the grooves, which are recess portions, are formed both at the upstream side and downstream side of the nip portion in the moving direction of the film.

Lattice-shaped grooves are provided as in the present embodiment, whereby lubricating grease holding power is improved and temperature distribution is prevented from becoming nonuniform in the widthwise direction of the film.

Further, a number of grooves 31 in any cross section, perpendicular to a long axis of the film guide 716, become the same in any cross section, the intervals and angle are set, whereby it becomes possible to attain uniform temperature distribution, and grease can be uniformly held between the film 710 and the surface of the film guide 716, which is also advantageous in reducing the sliding resistance.

Figure 5A:
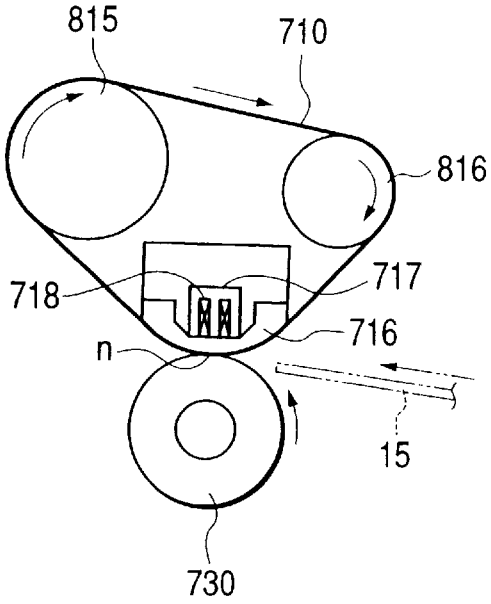
FIGS. 5A, 5B, 5C and 5D are views showing an image heating apparatus, to which the present invention is applicable.
Figure 5B:
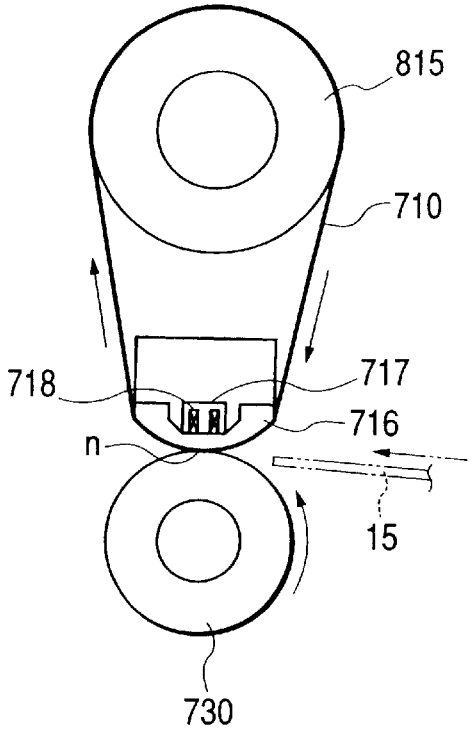
Figure 5C:
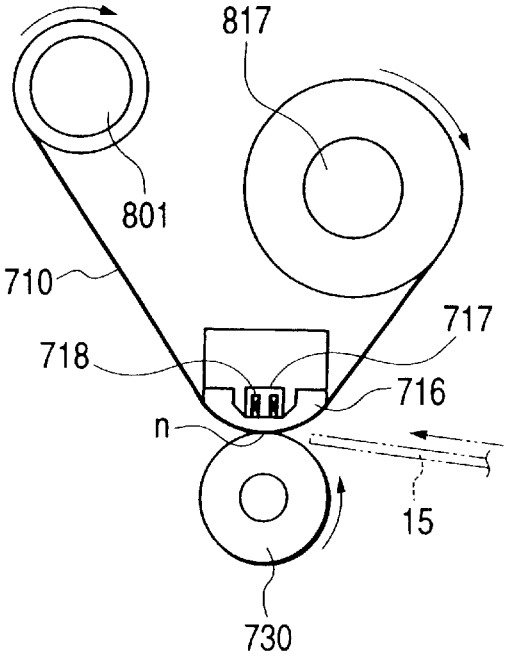
Figure 5D:
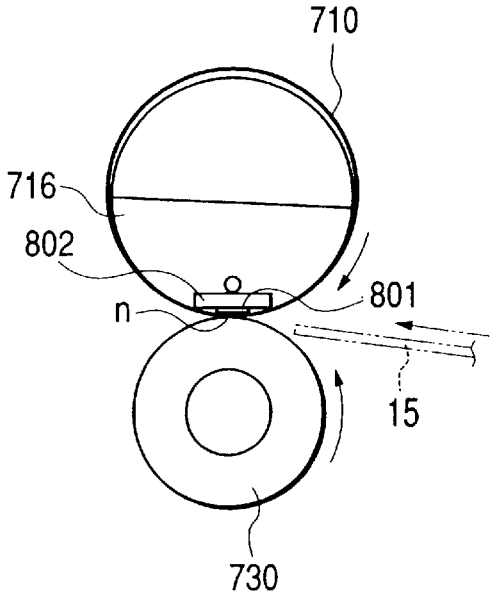

FIGS. 5A to 5C show different embodiments of an electromagnetic induction heating system of an image heating apparatus, and FIG. 5D shows an example of an image heating apparatus of a heating system using a resistance heat generating body. The guide surface is provided with a plurality of recess portions regardless of the configuration, whereby the same effect as the above described embodiments can be obtained.

An image heating apparatus shown in FIG. 5A is configured such that film 710 as an endless belt-shaped conductive member is tensioned and extended around three members: the under surface (guide surface) of a guide member 716 of electromagnetic induction heating structures 716, 717 and 718, a driving roller 815 and a driven roller (tension roller) 816 to rotationally drive the film 710 by the driving roller 815. Reference numeral 730 denotes a pressurizing roller which urges against the under surface of the guide member via the film 710, and which follows rotationally with rotational movement of the film 710.

An image heating apparatus shown in FIG. 5B is configured such that film 710 as an endless belt-shaped conductive member is tensioned and extended around two members: the under surface (guide surface) of a guide member 716 of electromagnetic induction heating structures 716, 717 and 718 and a driving roller 815 to rotationally drive it by a driving roller 815.

An image heating apparatus shown in FIG. 5C is configured such that as film 710 as a conductive member, and there is used long limited film rolled up and not an endless belt-shaped one, and this limited film is caused to travel from a pay-off shaft 817 side to a take-up shaft 818 side through the under surface (guide surface) of a guide member 716 of electromagnetic induction heating structures 716, 717 and 718 at a predetermined speed.

An image heating apparatus shown in FIG. 5D is configured such that endless-shaped film 710 is fitted over a guide member 716 holding a heater 802 (heating portion) equipped with a longitudinal linear resistance heating conductor 801 in the widthwise direction of the film, a pressurizing member 730 is urged against the under surface of the guide member with the film 710 being interposed therebetween, and the film 710 is rotationally driven along the outer peripheral surface (guide surface) of the guide member by the driving of the pressurizing member 730.

As described above, according to the present invention, the guide member is provided with a recess portion on the surface thereof, whereby it is possible to reduce sliding resistance between the movable member and the guide member without causing any damage to the movable member, and the lubricant is held over a long term and the recess portions are adequately disposed to uniformly disperse lubricant whereby it is possible to provide an image heating apparatus and an image forming apparatus which reduce the frictional resistance between the movable member and the guide member.

In the foregoing, the description has been made of embodiments of the present invention, however the present invention is not limited to the above described embodiments, but includes all modifications of the embodiments of the present invention that are obvious to those skilled in the art.

What is claimed is:

1. An image heating apparatus comprising:

a movable member;

a guide member for guiding a movement of said movable member; and a back up member for forming a nip portion with said guide member via said movable member, wherein a lubricant is provided between said movable member and said guide member, wherein a recording material bearing an image at said nip portion is pinched and conveyed, the image on the recording material is heated by a heat from said movable member side, and wherein said guide member has a recess portion for accumulating the lubricant in a guide portion different from said nip portion.

2. An image heating apparatus according to claim 1, wherein said recess portion is a hole.

3. An image heating apparatus according to claim 1, wherein said recess portion is a groove.

4. An image heating apparatus according to claim 3, wherein said groove is obliquely provided in a moving direction of said movable member.

5. An image heating apparatus according to claim 3, wherein said groove is provided in a lattice shape.

6. An image heating apparatus according to claim 1, wherein said recess portion is provided at least in a guide portion, on said guide member, on an upstream side of said nip portion in a moving direction of said movable member.

7. An image heating apparatus according to claim 1, wherein number of said recess portion in any cross section perpendicular to a direction for orthogonally intersecting a moving direction of said movable member is constant.

8. An image heating apparatus according to claim 1, wherein said movable member is endless-shaped film.

9. An image heating apparatus according to claim 8, wherein said film is wound around said guide member with an allowance.

10. An image heating apparatus according to claim 1, wherein said back up member is a roller for driving said movable member.

11. An image heating apparatus according to claim 1, further comprising magnetic flux generating means for generating a magnetic flux, wherein an eddy current is generated on said movable member by the magnetic flux generated by said magnetic flux generating means, and said movable member generates heat by the eddy.

12. An image heating apparatus according to claim 1, wherein said guide portion has a heating portion, and wherein said heating portion and said back up member are urged against each other via said movable member.

* * * * *

UNITED STATES PATENT AND TRADEMARK OFFICE

CERTIFICATE OF CORRECTION

PATENT NO. : 6,430,386 B2
DATED : August 6, 2002
INVENTOR(S) : Takateru Okubo et al.

It is certified that error appears in the above-identified patent and that said Letters Patent is hereby corrected as shown below:

Column 2,
Line 22, “potographic” should read -- photographic --.

Column 3,
Line 10, “made clean,” should read -- cleaned, --.
Line 26, “loose” should read -- loosely --.

Column 4,
Line 40, “upstream” should read -- at the upstream --.
Line 54, “above described” should read -- above-described --.

Column 5,
Line 12, “above described” should read -- above-described --.
Line 33, “as film 710” should read -- film 710 is used --.

Column 6,
Line 3, “above described” should read -- above-described --.

Signed and Sealed this

Fourteenth Day of January, 2003

JAMES E. ROGAN
*Director of the United States Patent and Trademark Office*